US011717066B1

(12) United States Patent
Navarro

(10) Patent No.: US 11,717,066 B1
(45) Date of Patent: Aug. 8, 2023

(54) COMBINATION TRAVEL BAG AND TABLE

(71) Applicant: Richard Navarro, Grapevine, TX (US)

(72) Inventor: Richard Navarro, Grapevine, TX (US)

( * ) Notice: Subject to any disclaimer, the term of this patent is extended or adjusted under 35 U.S.C. 154(b) by 269 days.

(21) Appl. No.: 17/101,216

(22) Filed: Nov. 23, 2020

Related U.S. Application Data

(60) Provisional application No. 62/939,175, filed on Nov. 22, 2019.

(51) Int. Cl.

| | |
|---|---|
| ***A45C 9/00*** | (2006.01) |
| ***A45C 5/03*** | (2006.01) |
| ***A45C 5/14*** | (2006.01) |
| ***A45C 13/38*** | (2006.01) |
| ***A45C 15/00*** | (2006.01) |

(52) U.S. Cl.
CPC ..... *A45C 9/00* (2013.01); *A45C 5/03* (2013.01); *A45C 5/14* (2013.01); *A45C 13/38* (2013.01); *A45C 15/00* (2013.01)

(58) Field of Classification Search
CPC .... A45C 9/00; A45C 5/03; A45C 5/14; A45C 13/38; A45C 15/00
See application file for complete search history.

(56) References Cited

U.S. PATENT DOCUMENTS

| | | | | |
|---|---|---|---|---|
| 5,437,367 | A * | 8/1995 | Martin | G06F 1/1628 206/320 |
| 6,237,734 | B1 * | 5/2001 | Chen | B62B 1/125 280/37 |
| 6,298,964 | B1 * | 10/2001 | Sadow | A45C 13/262 280/37 |
| 6,869,086 | B2 * | 3/2005 | Sadow | A45C 13/262 280/37 |
| 7,987,955 | B2 * | 8/2011 | Puchalski | A45C 9/00 190/11 |
| 8,534,434 | B2 * | 9/2013 | Crull | B25G 1/04 190/117 |
| 11,140,958 | B1 * | 10/2021 | Baldwin | A45C 13/28 |
| 2021/0016815 | A1 * | 1/2021 | Fleser | A45C 5/06 |

FOREIGN PATENT DOCUMENTS

| | | | |
|---|---|---|---|
| CN | 107822285 | A * | 3/2018 |
| CN | 108741559 | A * | 11/2018 |

* cited by examiner

*Primary Examiner* — Tri M Mai
(74) *Attorney, Agent, or Firm* — Kenneth L. Tolar

(57) ABSTRACT

A travel bag with a deployable table includes a hollow shell having a front wall, a rear wall, a pair of sidewalls, a top wall, and a bottom wall. The rear wall includes a compartment having a pivotal panel received therein. The panel can be deployed to an oblique position to form a handle that allows a traveler to easily roll the bag in an upright position. The deployed panel also supports a tray table for retaining food, beverages, electronic devices or personal items.

13 Claims, 4 Drawing Sheets

COMBINATION TRAVEL BAG AND TABLE

CROSS REFERENCE TO RELATED APPLICATIONS

This application claims priority of provisional application No. 62/939,175 filed on Nov. 22, 2019, the specification of which is incorporated herein by reference.

BACKGROUND OF THE INVENTION

The present invention relates to a rolling travel bag having a deployable table for supporting food, drinks, and personal items.

DESCRIPTION OF THE PRIOR ART

Airlines are increasingly discouraging checked luggage by assessing additional fees and/or limiting the quantity of bags that can be checked. Accordingly, many passengers opt to travel solely with carry-on baggage, which must contain all items needed for a given trip. As a result, such bags are becoming increasingly larger and more difficult to transport to and within an airport.

Moreover, airlines are now limiting in-flight food service and charging exorbitant fees for any food that may be offered. In response, many passengers bring their own food to eat during the flight or eat immediately before boarding. Simultaneously transporting larger luggage, food, laptops, mobile phones, and other personal items is burdensome, if not impossible. Furthermore, finding a suitable location to consume food and beverages near an airport gate with access to an available charging station for the electronic devices is difficult.

Rolling luggage has become increasingly popular due to its ease of transport. Though some carry-on luggage includes wheels, a traveler can typically only transport two bags, which occupies both hands. If traveling with children or additional items, getting to and from a departure or arrival gate may require special assistance or airport trolleys. Rolling luggage also includes a retractable, axially extending handle that requires the bag to be tilted forward when rolled along an underlying surface. The tilted luggage imposes a substantial strain on the traveler's shoulders, arms, and wrists.

Accordingly, there is currently a need for travel bag that overcomes the above-described disadvantages of conventional luggage. The present invention addresses this need by providing a rolling travel bag having a deployable tray for supporting food and beverages. When deployed, the tray mechanism also forms an obliquely extending handle that allows the bag to be easily dragged while upright, thereby eliminating any shoulder or arm strain. The travel bag also includes a means for connecting multiple units to form a train of bags that can be easily transported by a single traveler. Finally, the bag includes an integral charging unit for replenishing portable electronic devices.

SUMMARY OF THE INVENTION

The present invention relates to a travel bag with a deployable table comprising a hollow shell having a front wall, a rear wall, a pair of sidewalls, a top wall, and a bottom wall. The rear wall includes a compartment having a pivotal panel received therein. The panel can be deployed to an oblique position to form a handle that allows a traveler to easily roll the bag in an upright position. The deployed panel also supports a tray table for retaining food, beverages, electronic devices or personal items.

It is therefore an object of the present invention to provide a travel bag having a deployable tray table for supporting food, beverages, and personal items.

It is therefore another object of the present invention to provide a travel bag having an obliquely extending handle that allows the bag to be easily transported when upright.

It is yet another object of the present invention to provide a travel bag having a means for connecting multiple units to form a train of bags that can be easily transported by a single user.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
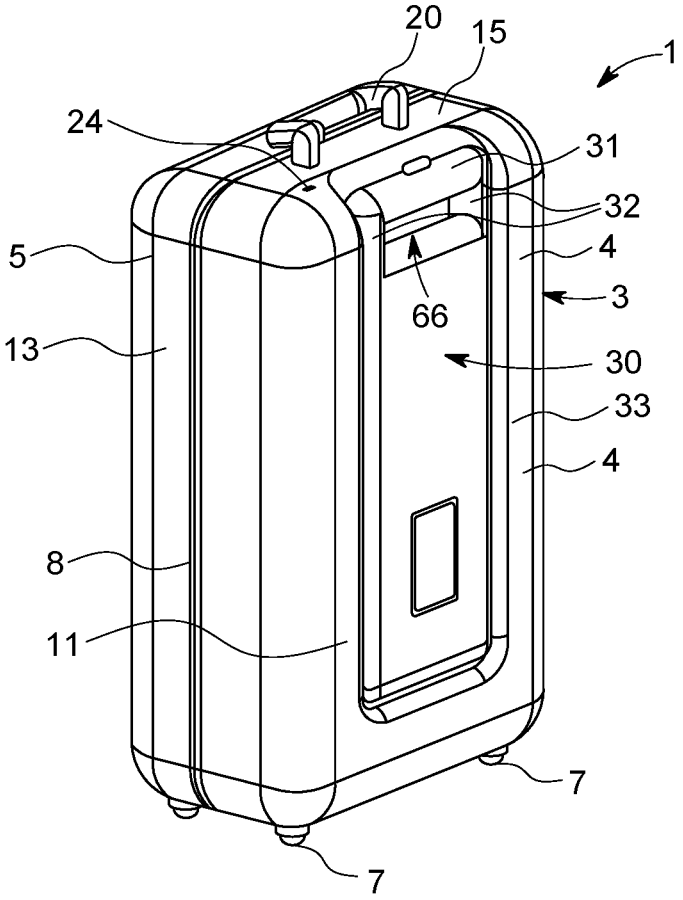
FIG. 1 is a rear, isometric view of the travel bag according to the present invention with the tray table in the stowed position.
Figure 2:
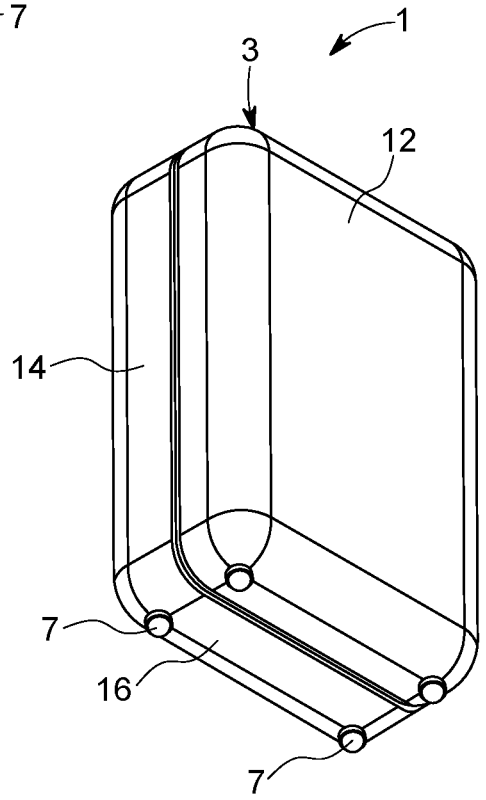
FIG. 2 is a bottom, isometric view of the travel bag with the handle in the stowed position.

The present invention relates to a travel bag 1 with a deployable table comprising a hollow shell having a front wall 12, a rear wall 11, a pair of sidewalls 13, 14, a top wall 15, and a bottom wall 16. On the top wall is a folding handle 20 for lifting the bag when necessary. Wheels 7 on the lower wall allow the bag to be easily rolled along an underlying surface. The shell is formed of front 5 and rear 4 sections that mate in a clamshell-type fashion as with conventional luggage. The front 5 and rear 4 sections may be releasably joined with a closure mechanism 8, such as a zipper.

A compartment 26 on the rear wall receives a deployable handle/table mechanism 30 including a planar panel 33 having a hand opening 66 near an upper edge that is defined by a pair of vertical, spaced posts 32 and a horizontal handgrip 31. The posts 32 may telescope to adjust the handgrip to accommodate a traveler's size or preference. The lower end of the panel 33 is connected to the shell with hinges 42 to allow the panel to pivot into and out of the compartment 26.

Figure 3A:
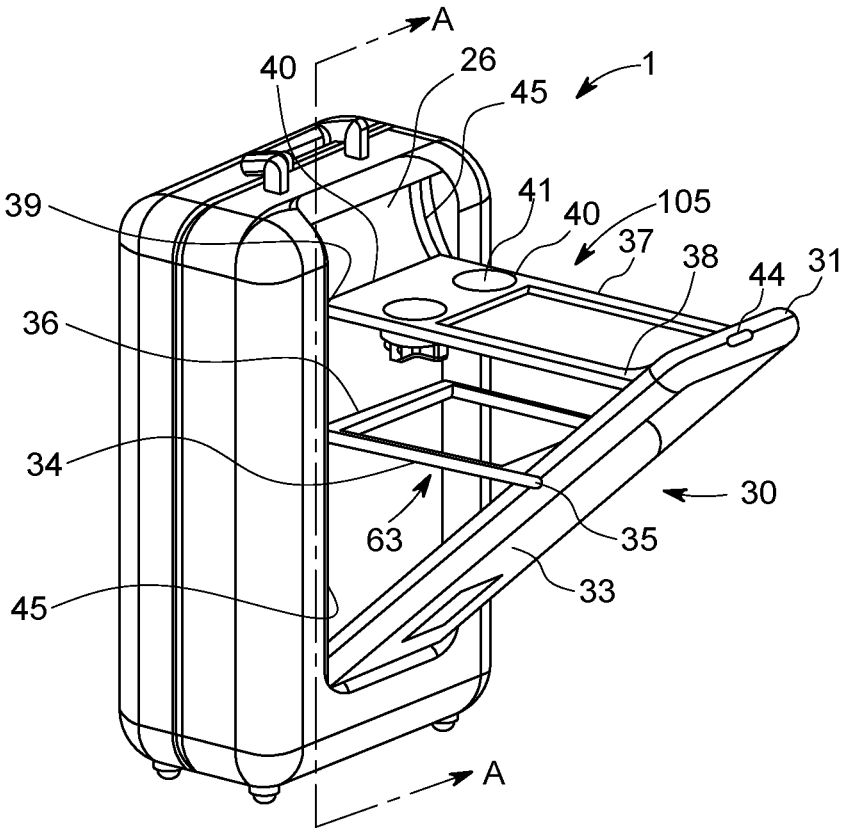
FIG. 3A depicts the travel bag of FIG. 1 with the tray in the deployed position.
Figure 4:
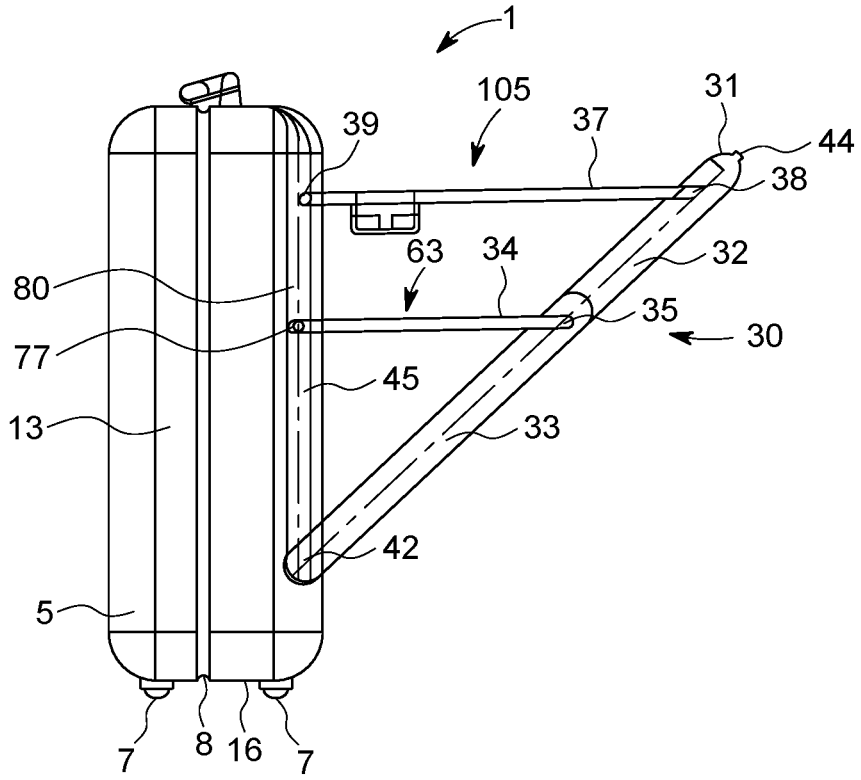
FIG. 4 is a side view of the travel bag with the tray table in the extended position.
Figure 5:
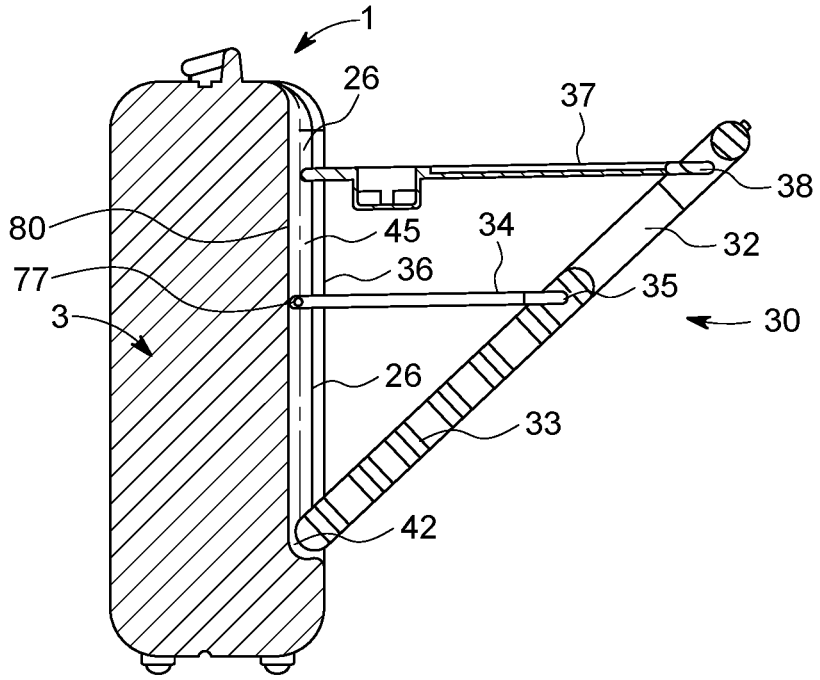
FIG. 5 is a cross-sectional view of the travel bag taken along A-A in FIG. 3A.
Figure 8:
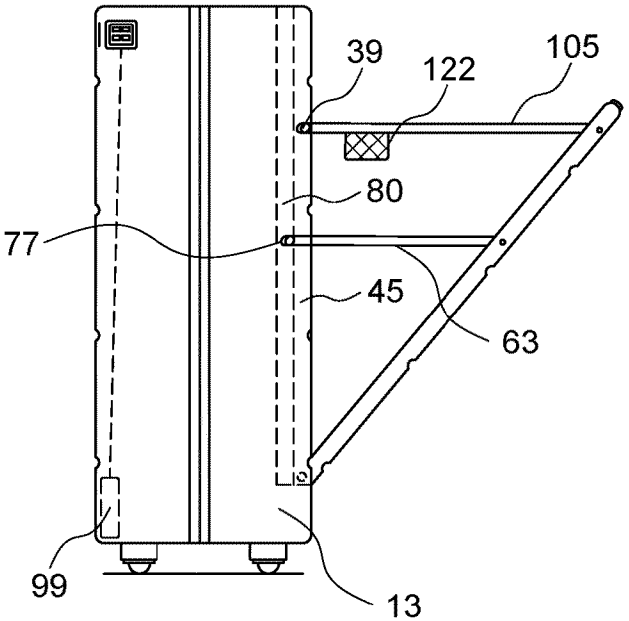
FIG. 8 is a side view of the travel bag with integral USB chargers.
Figure 6:
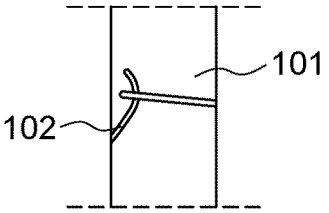
FIG. 6 is a sectional view of two adjacent, connected bags.
Figure 7:
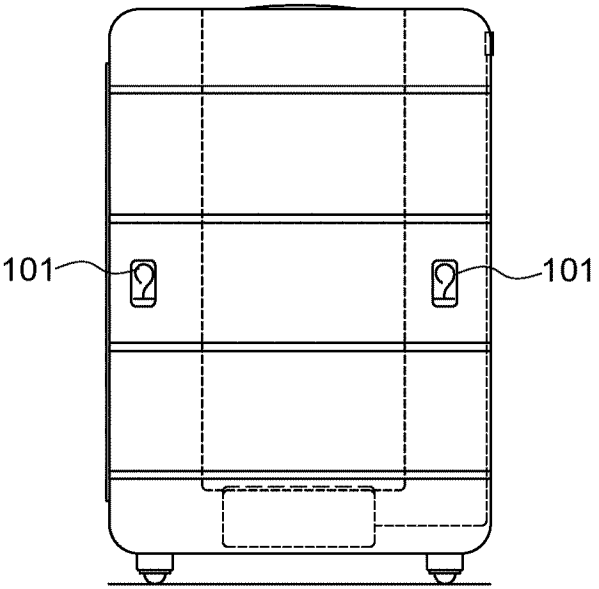
FIG. 7 is a front, plan view of the travel bag.

Extending from an intermediate portion of the panel is a lower support frame 63 formed of a pair of side rails 34 and an interposed cross member 36. The cross member includes a roller 77 at each end that rides within an inner channel 80 in the compartment 26. The inner channel 80 includes an indention for receiving and locking the rollers 77 to fix the frame 63 in a horizontal position as depicted in FIG. 4. The side rails 34 are connected to the panel with hinges 35 that allow the panel 33 to move between a stowed, vertical position as depicted in FIG. 1, and a deployed, oblique position as depicted in FIG. 3A. A spring-biased latch 44 releasably locks the panel within the compartment.

Figure 3B:
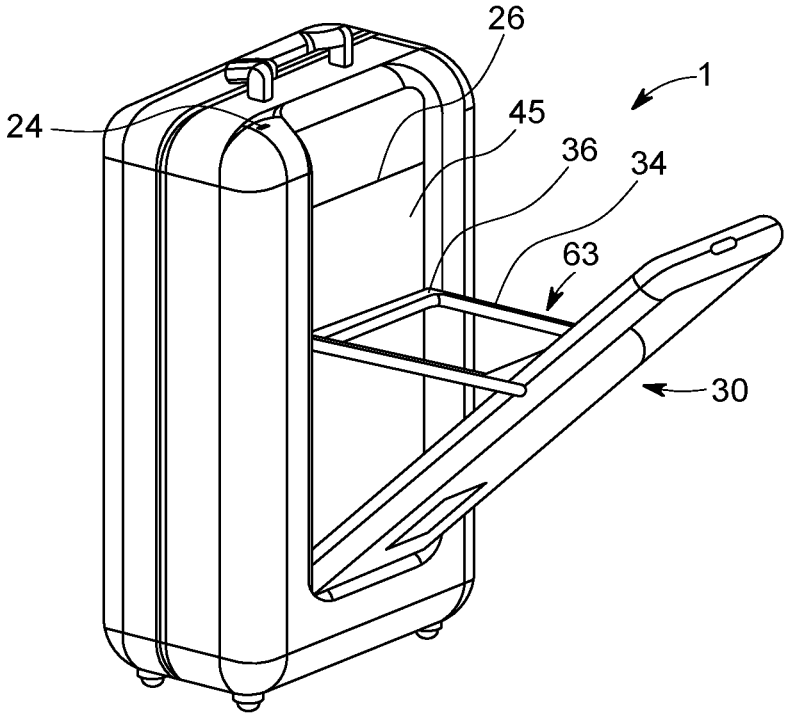
FIG. 3B depicts a different embodiment of the present invention with the panel in a deployed position.

An upper support frame 105 includes a pair of spaced arms 37 having a first end 38 hingedly attached to the panel. Opposing ends of the arms are connected to a tray table 40 having rollers 39 that ride within outer channels 45 to allow the upper support frame 105 to deploy and collapse with the panel. The outer channels 45 each include an indention for receiving and locking the rollers 39 to fix the frame 105 in a horizontal position as depicted in FIG. 4. The tray table 40 includes cup holders 41 with underlying mesh receptacles 122 for securing beverages when eating or while rolling the luggage through an airport. Preferably, the arms 37 are elevated slightly above the tray to form a barrier that prevents items from rolling off either side. Accordingly, a user can deploy the panel 33 to provide an oblique handle that minimizes strain to a traveler's shoulders, or to form a table for supporting food items, laptop computers or other work items. As depicted in FIG. 3B, the upper support frame and tray table could be eliminated so that the deployable panel functions solely as a handle.

A battery pack 99 is connected to a charging circuit and one or more USB ports 24 for recharging a mobile phone or laptop. On the rear wall of the shell are hooks 101 that can be extended from storage receptacles to couple with retainers 102 on the front wall of another travel bag. Therefore, two or more travel bags can be connected to form a train of multiple units that can be easily transported by a single traveler.

To use the above-described device, a traveler depresses the release latch to extend the panel to a partially or fully extended, oblique position. The traveler can easily grasp the handgrip and pull the luggage. Because the luggage remains upright, its entire weight is borne by the wheels thereby eliminating any strain to the user's back and shoulders. To support beverages, food, or a laptop while at a departure gate or similar location, a user completely extends the panel until the support frames are locked within their respective channels. Furthermore, beverages or food items can be safely placed on the tray while the bag is rolling with little risk of toppling or spillage. To restore the panel, the traveler pushes downwardly on the front edge of the tray and pivots the panel into the compartment until the latch mechanism engages.

The above-described device is not limited to the exact details of construction and enumeration of parts provided herein. Although the device has been primarily described as a carry-on bag, it could also be larger or otherwise configured to be a checked bag. Furthermore, the size, shape and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A travel bag comprising:

a hollow shell having a front wall, a rear wall and a lower surface;

a compartment on the rear wall of said shell;

a panel pivotally received within said compartment, said panel pivotal between a stowed, vertical position and a deployed, oblique position, wherein said panel forms a handle that allows said bag to remain upright when being dragged by said panel along an underlying surface;

a tray having a front end and a rear end, said rear end hingedly attached to a rear surface of said panel, and said front end slidably mounted within said compartment whereby when said panel is in the deployed, oblique position, said tray extends horizontally to form a table.

2. The travel bag according to claim 1 wherein said panel is planar.

3. The travel bag according to claim 2 wherein said panel has an opening near an upper edge that forms a hand opening.

4. The travel bag according to claim 1 further comprising a support frame extending from an intermediate portion of said panel and positioned below said tray, said support frame assuming a horizontal position when said panel is pivoted to the oblique position for structurally enhancing said panel and said tray.

5. The travel bag according to claim 4 further comprising a locking mechanism for fixing the support frame in the horizontal position.

6. The travel bag according to claim 4 wherein said tray includes elevated side edges to prevent items from rolling off said tray.

7. The travel bag according to claim 6 wherein said tray includes at least one cup holder.

8. The travel bag according to claim 5 wherein said support frame comprises:

a pair of side rails and an interposed cross member received within said compartment;

a roller at each end of said cross member that rides within an inner channel in said compartment.

9. The travel bag according to claim 8 wherein said locking mechanism includes an indention on said inner channel for receiving and locking the rollers to fix the frame in the horizontal position.

10. The travel bag according to claim 4 further comprising a charging unit integral with said shell for recharging a portable electronic device.

11. The travel bag according to claim 4 further comprising:

a hook on the rear wall of said shell;

a retainer on the front wall of said shell, said retainer configured to couple with said hook on a second travel bag whereby multiple travel bags can be connected to form a train that is transportable by a single traveler.

12. The travel bag according to claim 4 further comprising wheels on the lower surface of said shell for rolling on an underlying surface.

13. The travel bag according to claim 3 wherein said hand opening is defined by a pair of vertical, spaced posts and a horizontal handgrip.

* * * * *